US005785326A

United States Patent [19]

Chang

[11] Patent Number: 5,785,326

[45] Date of Patent: Jul. 28, 1998

[54] STRUCTURE FOR BRAKE ON ROLLER SKATES

[76] Inventor: Sheng-Tai Chang, No.510, Sec.5, Chung-shin Road, San-chung, Taipei, Taiwan

[21] Appl. No.: 639,522

[22] Filed: May 1, 1996

[51] Int. Cl.[6] ..... A63C 17/14

[52] U.S. Cl. ..... 280/11.2; 280/11.19

[58] Field of Search ..... 280/11.19, 11.2, 280/11.22, 11.23; 188/5, 74, 29, 57, 177

[56] References Cited

U.S. PATENT DOCUMENTS

| | | | |
|---|---|---|---|
| 4,807,893 | 2/1989 | Huang | 280/11.2 |
| 5,183,275 | 2/1993 | Hoskin | 280/11.2 |
| 5,211,409 | 5/1993 | Mitchell | 280/11.2 |
| 5,630,595 | 5/1997 | Perner | 280/11.2 |

*Primary Examiner*—Robert J. Oberleitner
*Assistant Examiner*—C. T. Bartz
*Attorney, Agent, or Firm*—Bacon & Thomas

[57] ABSTRACT

An improved structure of a brake on roller skates for improving the braking effect, having a braking set seat, a braking pad, a spring and an adjustable positioning rod, a guide member is provided extending down and rearwardly from the braking set seat to form a slightly inclined receiving space which can hold a spring. A block on the top of the braking pad is fitted into the receiving space from below, and an adjustable positioning rod can be inserted at a lateral side of the braking set seat straight into the block. When braking, pressing down of the braking set seat causes the braking pad to touch the ground, while further pressing causes the braking pad to contact a roller of the skate to ensure braking and safety of a user.

2 Claims, 5 Drawing Sheets

STRUCTURE FOR BRAKE ON ROLLER SKATES

BACKGROUND OF THE INVENTION

1. Field of the Invention

The present invention relates to an improved structure of a brake on roller skates, wherein, a braking pad, a spring and an adjustable positioning rod and a seat are provided to make a braking set at the rear of a roller skate, by combination of the braking pad with the braking set seat, braking effect can be controlled for fast stop of the roller skate.

2. Description of the Prior Art

The roller skates (commonly called skates) have been developing toward the tendency of avantguard as well as safety, this can be seen in all the rinks, in-line roller skates such as shown in FIG. 1 are most welcome by the youth.

The in-line roller skates are so called because they are characterized by arranging the rollers in one straight line, this is a big breakthrough against the traditional four wheel type (two wheels at the front and two wheels at the rear), and they are different in the position of the braking pads from that of the traditional ones, i.e., the braking pads of the traditional ones are placed at the front of the skates, while an in-line roller skate has its braking pads at the most tailing end of the skates, hence there is a big difference therebetween resided in braking action and arranging of the wheels. The inventor of the present invention provides a different view of observation on the braking effect of the in-line roller skates.

As shown in FIG. 1, wherein it shows the structure of an ealier brake of an in-line roller skate, and wherein, a braking pad B is embedded and positioned beneath and at the tailing end of a bottom seat A of a roller skate, then a bolt C is inserted transversly for fixing, this can get the braking effect, however, the bottom seat A of the roller skate must be raised when in braking, so that the braking pad B can be touched with the ground to make braking, after using for a period of time, the braking pad B gets gradually smaller by rubbing with the ground, the bottom seat A of the roller skate must be raised more higher when in braking, this action will influence body equilibrium of the skater, or even worry of a tendency of falling down may exist, such structure of a brake is gradually abolished due to this factor; besides, the bottom seat A mostly is formed integratedly with the roller skate, when it is damaged, function of the braking pad B can be adversly affected of course.

Accordingly, some manufacturers provide at the rear of the bottom seat A of the roller skate a separated braking pad seat D, such as shown in FIG. 2, the braking pad seat D can be separable, but its structure is simple, the braking pad seat D is movable, meanwhile, a braking pad E is provided at the bottom of the braking pad seat D, and a braking sheet E1 is extended from the braking pad E forwardly, so that when in braking, and when the braking pad E touches the ground, a down pressing momentum will render the braking pad seat D to move slightly forwardly, so that the braking sheet E1 will have a point contact with a friction roller F, braking effect of this structure may be better than what is before, equilibrium of body may get lost though due to movability of the braking pad seat D during press braking, and braking effect made by only the point contact of the braking sheet E1 will contrarily induce resistance rather than gives aid to a skater.

SUMMARY OF THE INVENTION

In view of the aforesaid disadvantage, the inventor of the present invention provides an improved structure of a brake on roller skates for eliminating such disadvantage after continuous study as well as designing based on his experience of years in producing, selling roller skates and visiting to many youth for knowing their requirement on the roller skates in the markets; particularly, as a primary feature of the structure of the present invention, a guide member is provided bevelly at the rear end of a braking set seat, the guide member forms a receiving space for receiving a spring and a declined block provided on the top of a braking pad which is mounted by inserting from below into the space and is located in position by using a positioning rod inserted laterally, by pressing down the braking set seat when in braking to render the braking pad to touch the ground, meantime, to render the braking pad to touch the front wheel, to thereby make a tight and effective braking as being the primary object of the prensent invention.

The secondary object of the prensent invention is to make receiving of the guide member and the declined block to be in a declined mode, wherein, the spring is used to render the braking pad to touch the ground to establish the first braking, meantime, the braking pad touches the rear face of the rearmost wheel, to thereby establish the second braking, so that the roller skate can be held tight to stop sliding in a moment.

The present invention will be apparent in its practical structure, technical measures in operation and objects after reading the detailed description of the preferred embodiment thereof in reference to the accompanying drawings.

DETAILED DESCRIPTION OF THE PREFERRED EMBODIMENT

Figure 1:
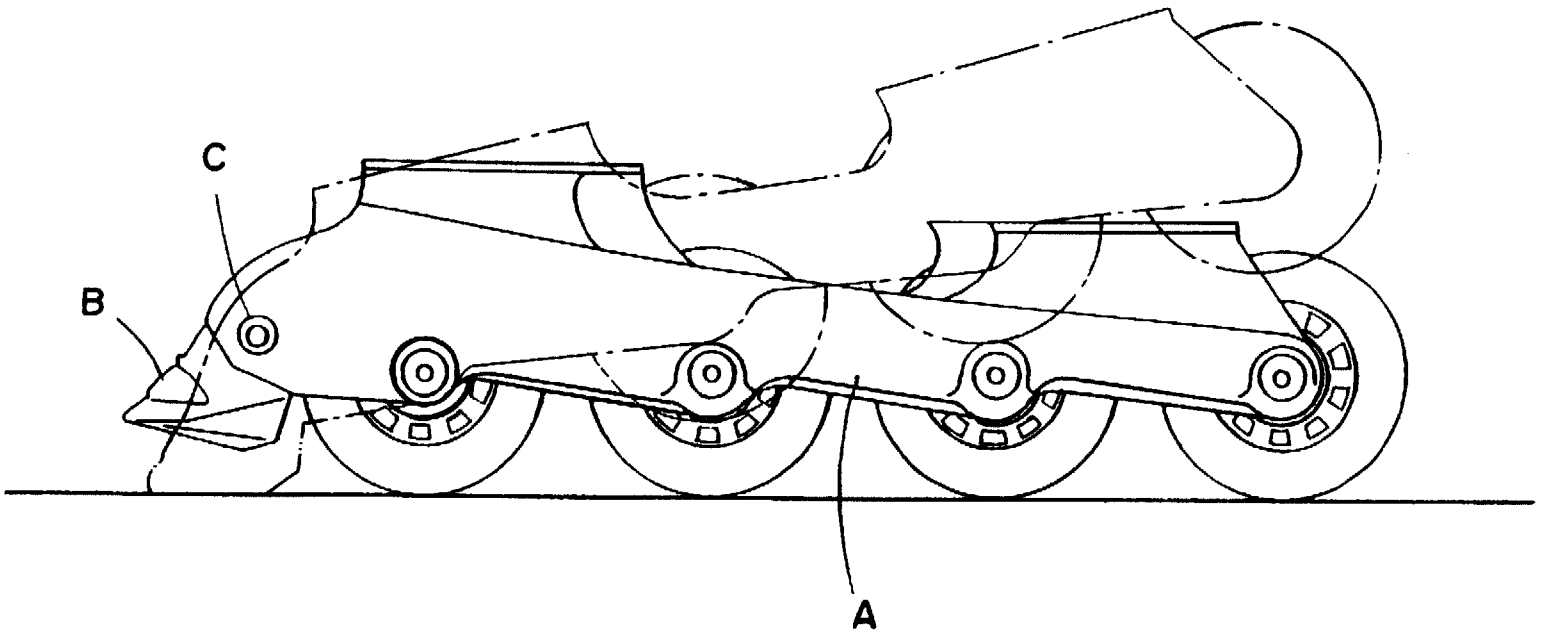
FIG. 1 PRIOR ART
FIG. 1 is a view of a conventional roller skate.
Figure 2:
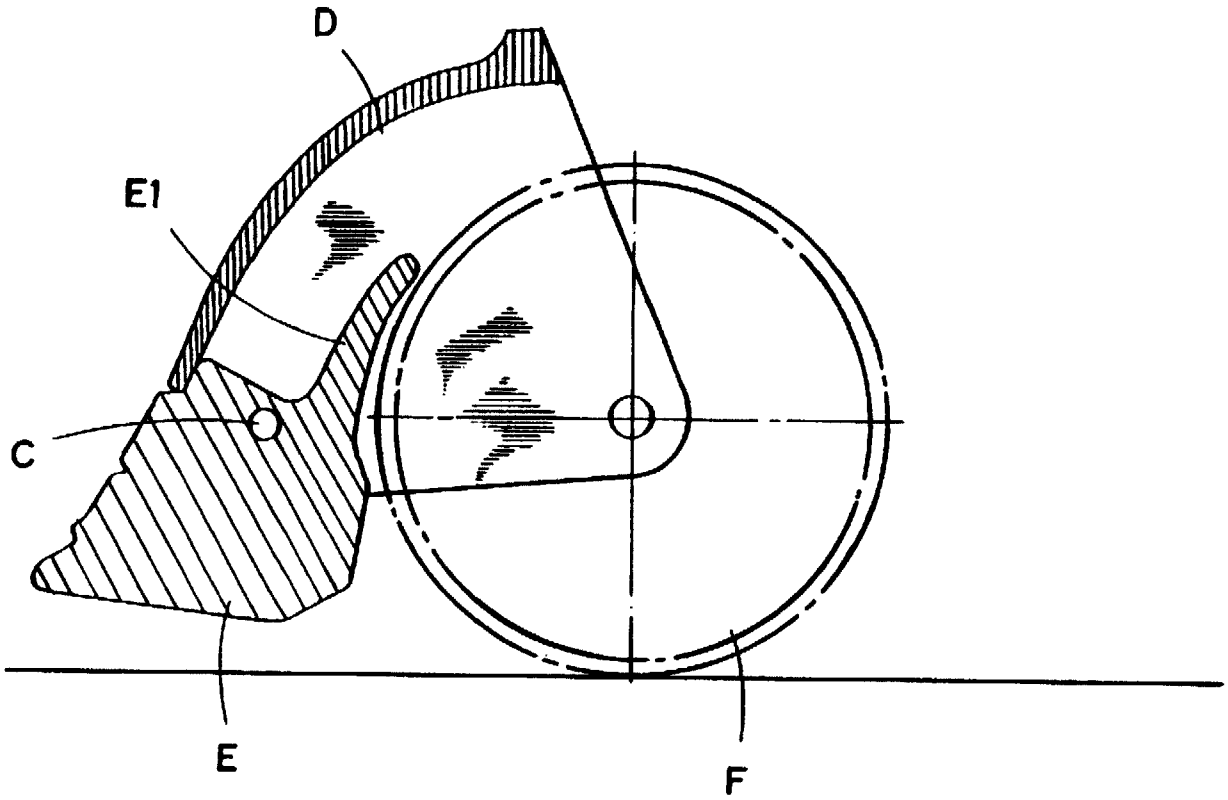
FIG. 2 PRIOR ART
FIG. 2 is a sectional view of a braking set seat on a second conventional roller skate.
Figure 3:
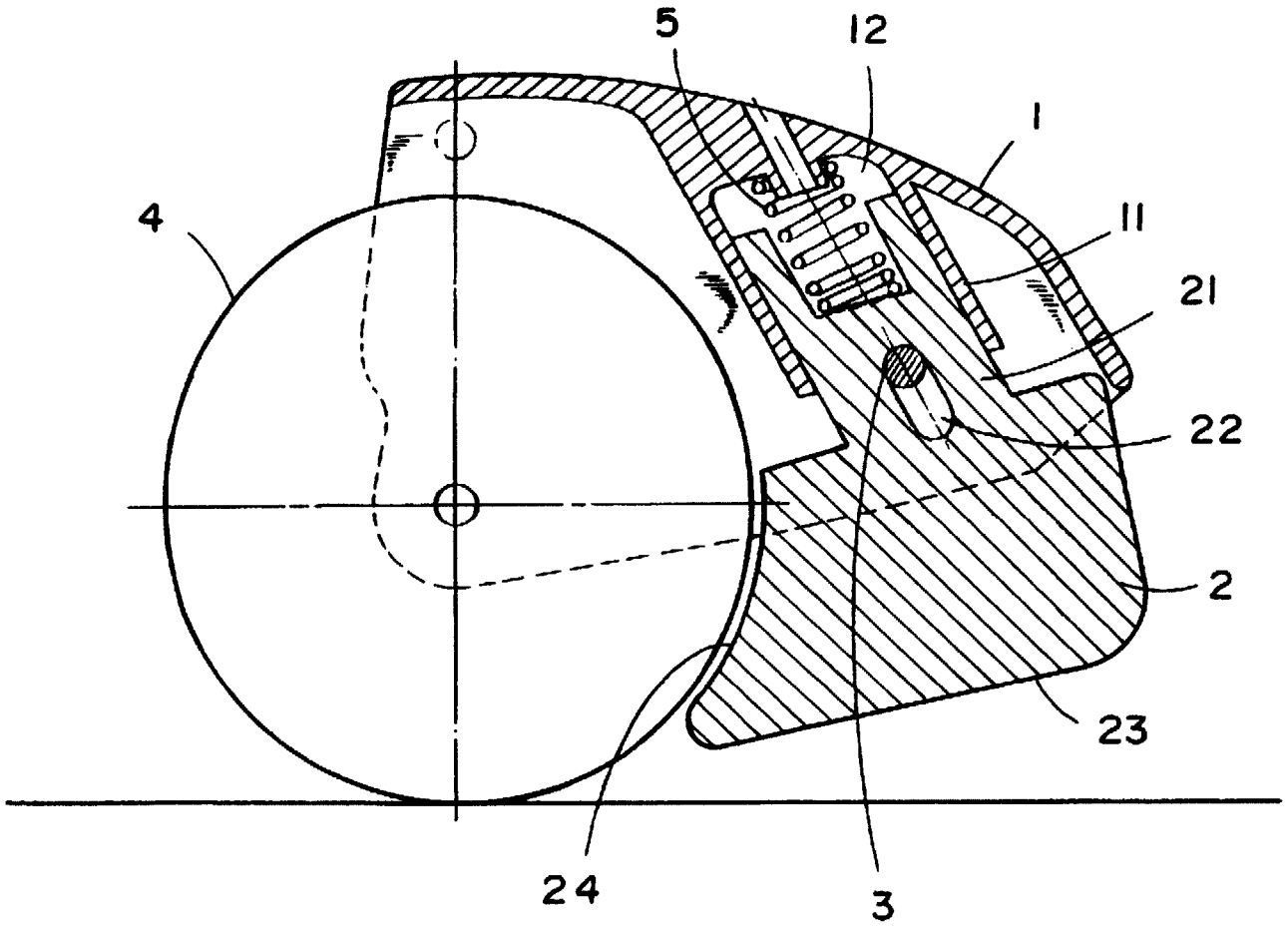
FIG. 3 is a sectional view of the assembly of the present invention.

In the preferred embodiment of the present invention, similar reference characters are used to designate similar parts in the structure of a brake on the roller skate throughout the several views.

The brake structure of the present invention on the roller skate is comprised of a braking set seat 1 which is provided at the most tailing end of rollers and is assembled together with the last roller 4 of the rollers arranged in one straight line, the braking set seat 1 is in the shape of "U" straddling both sides of the roller 4 to form a housing, a guide member 11 of slightly square shape is bevelly provided and integratedly formed with and extends down and rearwardly from the inner surface of the braking set seat 1 to thereby form a slightly declined receiving space 12 facing downwardly, the receiving space 12 can hold a spring 5 in antecedence.

The present invention also is comprised of a braking pad 2 which is made of strengthened rubber, the bottom thereof is slightly similar to those of the conventional braking pad B, E, I, a declined block 21 is extended from the top of the braking pad 2, the declined block 21 can be fitted in the receiving space 12 of the guide member 11, a positioning slot 22 is laterally provided on the each side of the declined block 21, orientation of the positioning slot 22 is the same as the declining orientation of the declined block 21, so that an adjustable positioning rod 3 can be inserted at a lateral side of the braking set seat 1 straight into the declined block 21 of the braking pad 2.

By means of the above stated structural assembly, in declination of the guide member 11 on the braking set seat 1, with the adjustable positioning rod 3 inserted through the braking pad 2 of which the declined block 21 being received in the receiving space 12 of the guide member 11, using the spring 5 to endow the braking pad 2 with a stretching space, the braking pad 2 can be constrained by the positioning slot 22 and be prevented from falling.

Figure 4:
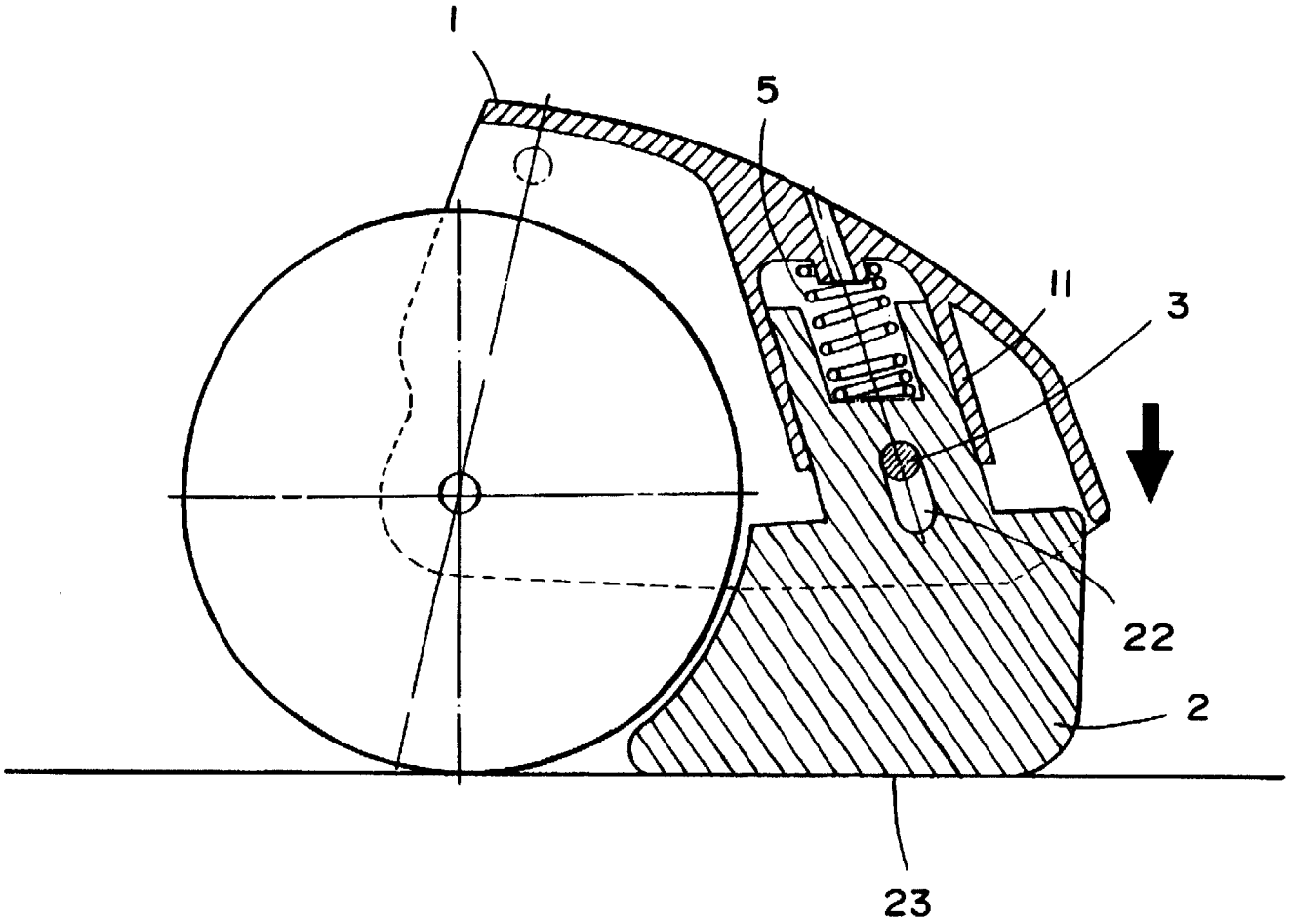
FIG. 4 is a schematic sectional view of the present invention showing the first braking effect.
Figure 5:
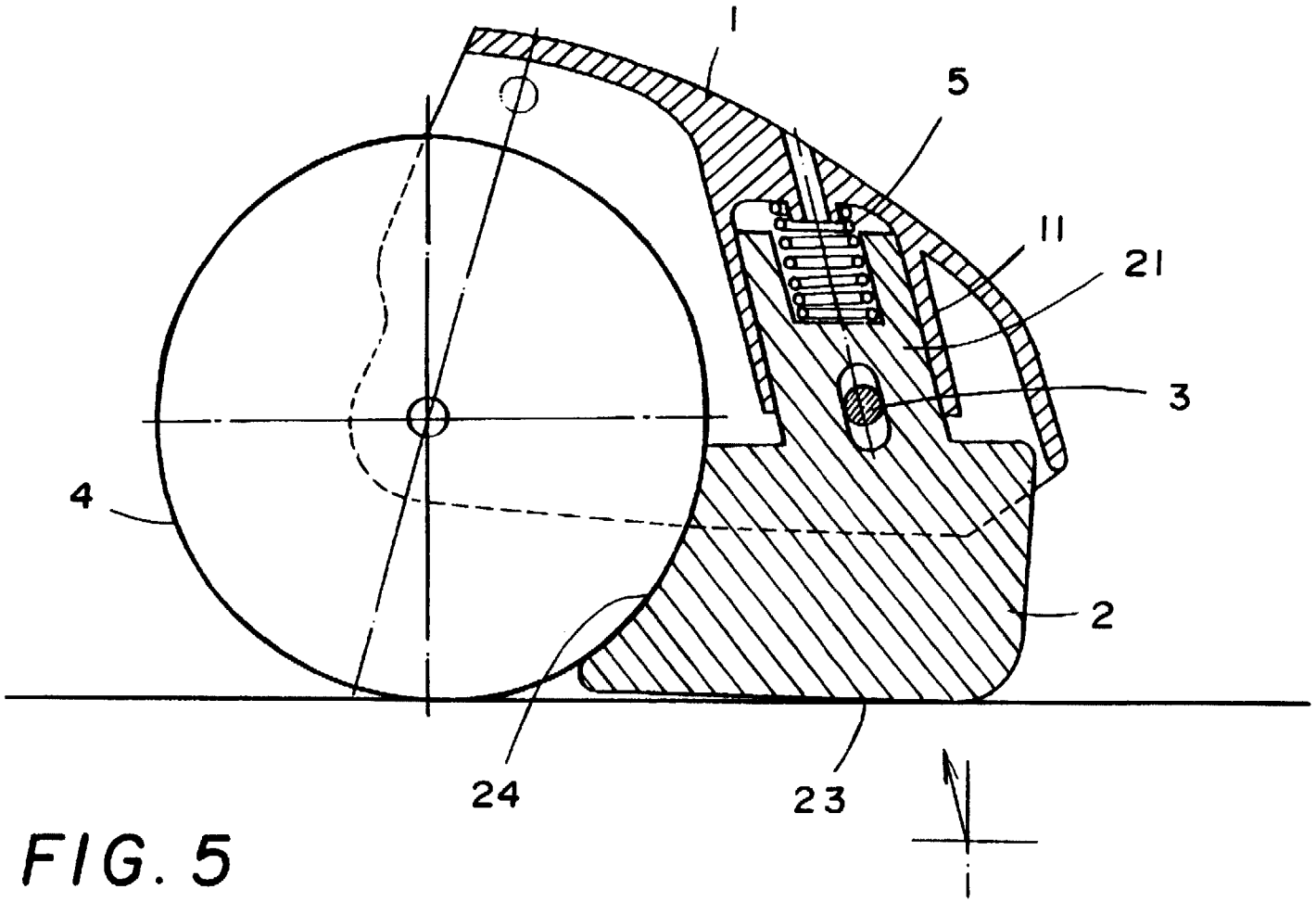
FIG. 5 is a schematic sectional view of the present invention showing the second braking effect.

The basic structural embodiment of the present invention is designed for the brake structure of a totally assembled roller skate, braking action thereof can be clearly shown by FIGS. 4 and 5, wherein, with providing of the in-line rollers 4, the braking set seat 1 is provided at the most tailing end of rollers and is assembled together with the last one of the rollers 4, when the leading roller 4 is raised up in braking, the braking set seat 1 at the tailing end is driven to move to the ground slightly, and when the braking set seat 1 is lowered, the bottom surface 23 of the braking pad 2 touches the ground to create a friction action and establish the first braking, as is shown in FIG. 4, such first braking is created mainly by slight down-pressing of the braking set seat 1, when a skater stop sliding, such braking can be stopped, this is called the first braking.

During the first braking, if frictional contacting of only the bottom surface 23 of the braking pad 2 with the ground is insufficient to stop sliding of a skater, the skater can force downward the braking set seat 1 further to render an arc shaped contacting furface 24 on the braking pad 2 to contact fittedly with the rear face of the rearmost roller 4 by action of the declined block 21 and the oblique guide member 11 to thereby establish a second braking to stop sliding in a moment, during the second braking, the first braking is of course existing simultaneously, the second braking is endued with an elastic function by providing the spring 5, i.e., contacting of the arc shaped contacting furface 24 on the braking pad 2 with the rear face of the rearmost roller 4 and of the bottom surface 23 of the braking pad 2 with the ground all are endued with cusion effect, therefore, the braking set seat 1 can be avoided of being over pressed.

In designing the present invention, it was considered that a skater can have movements other than linear movement, there may be curved movement and extreme movements such as jumping, stepping, and stamping etc., the inventor has noticed coincedence of the structure of the brake with the above stated various situation, and noticed that the braking pad 2 shall not be destroyed, in this consideration, the second braking is provided in the present invention.

When in practising, the present invention can be used in various in-line skates, the necessary measures are protecting of the structure of the skate and providing safety in sliding motion. When in pressing down of the braking set seat 1 to render the braking pad 2 to touch the ground, the braking set seat 1 can be avoided of being over pressed. And when it is uneasy to stop sliding after the first braking, the second braking formed by surface contacting of the arc shaped contacting furface 24 on the braking pad 2 with the rear face of the rearmost roller 4 can deal with all the situations, further with the aid of the spring 5, over pressing in braking which will induce inequilibrium and danger can be avoided.

In conclusion, the improved structure of a brake on the roller skate of the present invention provides the second braking by means of the combination of the declined block 21 and the guide member 11, and provides cusion effect by providing the spring 5 which can prevent from over pressing of the brake and can provide a space for spring function, safety can thus be improved.

Having thus described the technical structure of my invention with practicability and improveness, therefore, what I claim as new and desire to be secured by Letters Patent of the United States is:

1. A brake for a roller skate having at least one roller configured to roll upon a support surface, the brake comprising:

a braking set seat connecting at a front end with a roller of said roller skate, the braking set seat having a guide member with a receiving space extending downwardly therefrom toward the support surface, the receiving space having a longitudinal axis extending at an oblique angle relative to the support surface;

a braking pad having a block extending upwardly therefrom and slidably received in said receiving space, the braking pad having a bottom surface and a concavely arcuate contacting surface facing the at least one roller of the roller skate;

a positioning slot formed in the braking pad; and a positioning rod engaging the positioning slot whereby the braking pad is translationally movable relative to the braking set seat along a linear path, such that movement of the braking set seat towards the support surface brings the bottom surface of the braking pad into contact with the support surface to provide a first braking effect and further movement of the braking set seat causes translational movement of the braking pad along the oblique axis of the receiving space whereby the braking pad moves toward the at least one roller until the arcuate contacting surface contacts the at least one roller to provide a second braking effect.

2. The brake for a roller skate as stated in claim 1, further comprising a spring located in said guide member and bearing against the block of the braking pad urging the braking pad in a direction away from the braking set seat.

* * * * *